US005641199A

United States Patent [19]

Bond-Madsen

[11] Patent Number: 5,641,199

[45] Date of Patent: Jun. 24, 1997

[54] COMBINATION BACKPACK AND CHAIR COVER

[76] Inventor: Winnie Bond-Madsen, 14272 Acacia Dr., Tustin, Calif. 92680

[21] Appl. No.: 433,940

[22] Filed: May 2, 1995

Related U.S. Application Data

[60] Division of Ser. No. 246,735, May 20, 1994, Pat. No. 5,584,422, which is a continuation-in-part of Ser. No. 43,210, Apr. 5, 1993, abandoned.

[51] Int. Cl.[6] ..... A47C 31/11; A45F 4/02

[52] U.S. Cl. ..... 297/229; 297/129; 297/228; 224/153; 224/155; 224/657; 224/658; 224/901.6; 383/4

[58] Field of Search ..... 224/153, 155, 224/156, 209, 151, 210, 211, 212, 215, 657, 658, 901.6; 190/903, 2; 383/4; 5/417, 420; 297/219.1, 225, 229, 188.06, 188.2, 129

[56] References Cited

U.S. PATENT DOCUMENTS

| | | | |
|---|---|---|---|
| 2,270,598 | 1/1942 | Morgan | 297/188.06 |
| 2,740,466 | 4/1956 | Du Priest . | |
| 2,764,327 | 9/1956 | Stevenson . | |
| 3,622,056 | 11/1971 | Droeger . | |
| 3,662,932 | 5/1972 | Kerschner . | |
| 3,763,972 | 10/1973 | Karzmar . | |
| 3,777,862 | 12/1973 | Zipper . | |
| 3,818,962 | 6/1974 | Muller-Scherak . | |
| 3,994,372 | 11/1976 | Geller et al. . | |
| 4,236,657 | 12/1980 | Brunton . | |
| 4,423,834 | 1/1984 | Rush . | |
| 4,509,645 | 4/1985 | Hotta . | |
| 4,597,605 | 7/1986 | Gilbert | 297/188.06 |
| 4,604,765 | 8/1986 | Schultz . | |
| 4,783,120 | 11/1988 | Kiechlin . | |
| 4,854,637 | 8/1989 | McCree | 297/188.2 |
| 4,863,003 | 9/1989 | Carter . | |
| 4,901,897 | 2/1990 | Briggs et al. . | |
| 4,925,064 | 5/1990 | Comora . | |
| 4,961,522 | 10/1990 | Weber . | |
| 4,984,906 | 1/1991 | Little . | |
| 5,016,792 | 5/1991 | Jay . | |
| 5,090,526 | 2/1992 | Jacober . | |
| 5,120,108 | 6/1992 | Watson et al. | 297/188.2 |
| 5,395,023 | 3/1995 | Naymark | 224/901 |

FOREIGN PATENT DOCUMENTS

| | | |
|---|---|---|
| 2220407 | 1/1990 | United Kingdom . |

*Primary Examiner*—Linda J. Sholl
*Attorney, Agent, or Firm*—Lyon & Lyon LLP

[57] ABSTRACT

A combination backpack and chair cover, comprising first and second broad panels arranged in generally upright aligned, spaced apart relationship to form the front and rear portions, respectively, of the backpack, a shorter third panel hingedly attached along its opposed marginal edges to the respective lower edges of the first and second panels to form the bottom of the backpack, opposed fourth and fifth side panels co-extensive with and hingedly attached to the first panel along the mutual side marginal edges thereof, a sixth panel hingedly attached to the first panel to form the top of the backpack, strap apparatus attached to the first panel to support the backpack in carrying position and inter-engaging fastening device attached to the non-hingedly connected edges of the panels, and shiftable between a first position, wherein all panels are interconnected along their marginal edges to form an enclosed backpack, and a second position, wherein the panels are opened to allow the first, second and third panels to form an elongated cover for the back and seat portions of a chair and the side panels provide further, lateral coverage to the seat portion of the chair.

6 Claims, 10 Drawing Sheets

COMBINATION BACKPACK AND CHAIR COVER

INTRODUCTION

This application is a divisional of application Ser. No. 08/246,735 filed May 20, 1994 now U.S. Pat. No. 5,584,422, which is a continuation-in-part of application Ser. No. 08/043,210 filed Apr. 5, 1993, now abandoned, the disclosures of which are incorporated herein by reference therefor.

FIELD OF THE INVENTION

This invention relates to the field of sports accessories. More particularly, this invention relates to covers for stadium seats or chairs carryable as a unitized backpack in which other accessories may also be transported.

BACKGROUND OF THE INVENTION

Enjoyment of sporting events is a natural way of life. While television and radio communication offers some insight into various aspects of the sport, nothing compares to actual attendance to bring out the zest and excitement of the event and, whether conducted out of doors or indoors, a fuller appreciation of the meld of human endeavor and Mother Nature.

Spectator seating currently ranges from the outdoor bleachers through semi-enclosed and fully-enclosed domed stadiums to the air conditioned comfort of loge accommodations. Contemporary attendees, however, can usually afford only the bleacher bench seats and/or the modem semi-padded stadium seats. Although these seats are designed to support the spectator, none are remarkable at providing sustained comfort throughout the whole of the sport event. While youngsters are seemingly indifferent to the hardness of the seats, older persons frequently become distracted because of the discomfort generated by having to sit on rigid seats, often in windy and cold weather conditions. Elderly persons, who enjoy sporting events as much as others, tend to experience cold legs and feet when sitting on unpadded or semi-padded stadium seats for any length of time. Hence, it has been shown that extra padding, brought into the stadium, will significantly improve comfort to the spectator and bring about more enjoyment of the sporting event.

The prior art has attempted to deal with this problem by designing portable padded seat covers that may be carried into the sports event and laid on top of the seat. For the most part, this prior art is divided into travel bags, stadium seats, combination seat cushion and tote bags, and backpacks, either with accessory chair liners or convertible-to-other configurations.

In the travel bag prior art, U.S. Pat. Nos. 4,901,897 and 4,961,922 disclose mere soft bags, carryable by shoulder straps and otherwise, for carrying items to and from an event. There is no hint that such bags could adequately serve as both a conveying medium and a seat cover.

In the combination seat cushion and tote bag art, U.S. Pat. No. 3,763,972 discloses a two-sided, hinged carrying bag that is unfoldable to a seat cover, and that further contains an internal pouch for carrying liquid refreshment containers for hanging from the front of the stadium seat behind the user's legs. While the issue of the comfort of having bottles bump against the back of one's legs throughout a sporting event is not debated here, the fact remains that one must hand-carry the device to and from the stadium, thus confining one's hand and arm to that task and reducing the availability of two hands to hold stair rails, the arms of parents and the hands of children. U.S. Pat. No. 4,863,003 discloses a similar seat cushion/tote bag combination where, again, the device must be carried by hand thus eliminating the user's ability to use both hands and arms in ascending and descending treacherous steps, heavy concentrations of spectators, fidgety children and the like.

In the portable seat cushion art, U.S. Pat. Nos. 2,740,466 and 4,783,120 show typical devices that may be carried by hand to and from the sporting event. These inventions illustrate the combined problems of requiring use of one's hand and arm while at the same time failing to provide a vehicle in which to carry other desirable sporting event accessories such as a camera, a video recorder, extra clothes, and the like. These items require an additional carrying device, thus further burdening an already burdened spectator.

In the backpack prior art, U.S. Pat. No. 4,236,657 discloses a typical backpack that is unfoldable into a myriad of panels, none appearing to be particularly useful as a stadium chair cover. U.S. Pat. Nos. 3,622,056 and 4,925,064 disclose backpacks for carrying items therein and an additional device, carryable along with the backpack, to act as a chair or seat liner. While such dual devices are undoubtedly desirable in the wild, for stadium use, one would have the unenviable task of unloading the backpack separately from the stadium seat accessory, unrolling and positioning the seat cover, and then finding a place to store the partially or fully emptied backpack. Said activity might possibly disturb adjacent spectators.

U.S. Pat. No. 3,662,932 discloses a backpack convertible to a stool. While carrying the backpack clearly leaves both hands and arms free for use with other important tasks, the desirability of setting up a stool, either on top of or in from of an existing stadium seat, already reserved for the user, would probably be uncomfortable for the user and a distraction to those seated nearby. In addition, the rigid frame of the backpack would make it difficult to hide from view and would be uncomfortable to hold in one's lap for the duration of the sporting event.

U.S. Pat. No. 5,016,792 discloses a backpack convertible to a chair. While this appears to resolve the need for keeping the hands free during movement to and from the stadium, a means for carrying other items and providing an additional chair, it lacks some important features. First, it contains a rigid frame that, while making the backpack rigid, serves to inhibit the chair's use as a seat cover similar to the '932 patent. Secondly, the chair would probably not be a comfortable overlay to an existing stadium chair unless the two were compatible in size and shape; the chances of that are quite slim. Finally, the device does not include lateral seat cushioning.

Lateral seat cushioning is a feature where extra padding is provided outboard of the existing seat cushion of the stadium chair. More often than not, stadium chairs are made of steel or cast iron to provide rigidity to the chair and strength sufficient to withstand the up and down jumping activity of an exuberant fan. This metal frame work can become very cold or very hot to the much depending upon the existing weather conditions. To provide real stadium seat comfort, additional covering is needed outboard of the seat portion to prevent contact between the spectator's thighs and this metal frame work.

Thus, while the prior art has attempted to deal with these problems, there still remains a need for a lightweight backpack for carrying items to and from a sporting event that is convertible to a stadium seat cover that contains the additional feature of lateral seat cushioning. Such a device is not presently in existence.

SUMMARY OF THE INVENTION

This invention overcomes all of the shortcomings of the prior art previously disclosed herein and provides the additional feature desired in a stadium's cushion, namely lateral seat cushioning. The invention is a combination backpack and chair cover comprising first and second padded broad panels arranged for generally upright, aligned, spaced-apart relationship to form the front and rear portions respectively of the backpack, a shorter third panel hingedly attached along its opposed marginal edges to the respective lower edges of the first and second panels to form the bottom of the backpack, opposed fourth and fifth narrow side panels, co-extensive with and hingedly attached to the first panel along the mutual side marginal edges thereof, a sixth panel hingedly attached to the second panel to form the top of the backpack, a strap attached to the first panel to support the backpack in carrying position, and an inter-engaging fastener attached to the panels, and is shiftable between a first position, having all the panels interconnected along their marginal edges to form an enclosed backpack, and a second position having the panels opened to allow the first, second and third panels to form an elongated cover for the back and seat portions of a chair and the side panels provide further, lateral coverage to the seat portion of the chair. The invention holds its shape because the way the panels are shaped and inter-connected, thus removing the need for rigid frame members. It is lightweight due to the materials of construction. It frees both hands and arms to allow one to control children and assist elderly persons. It is easily convertible by mere shifting of zippers, or other fasteners, into a stadium chair cover configuration. And, it provides the desired feature of lateral seat cushioning. It is made of inexpensive materials so as to be within the reach of most pocketbooks. Its front and side panels provide an excellent location on which to place advertising material or team logos.

Accordingly, the main object of this invention is a combination backpack and chair covering comprising a low-cost, highly useful device that provides lateral support to the seat portion of the stadium chair. Other objects include a combination backpack and chair cover that holds its shape because of the way the panels are shaped and interconnected thus removing the need for rigid frame members; a lightweight device that frees both hands and arms to allow one to control children and assist elderly persons while transporting the device to and from a sports event; a device that is easily convertible from a backpack to a chair cover by merely shifting zippers, or other fasteners, between the respective components; a device made of inexpensive material so as to be within the reach of most pocketbooks; and, a device wherein the front and side panels provide an excellent location on which to place advertising. These and other objects of the invention will become more apparent by reading the following Description of the Preferred Embodiment taken together with the drawings that are appended hereto. The scope of protection sought by the inventor may be gleaned from a fair reading of the claims that conclude this specification.

DESCRIPTION OF THE PREFERRED EMBODIMENTS

Figure 1B:
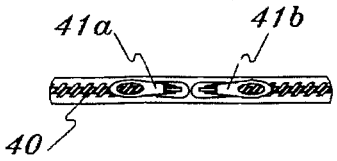
FIG. 1*b* is a close-up view of the zipper slides shown in FIG. 1.
Figure 1:
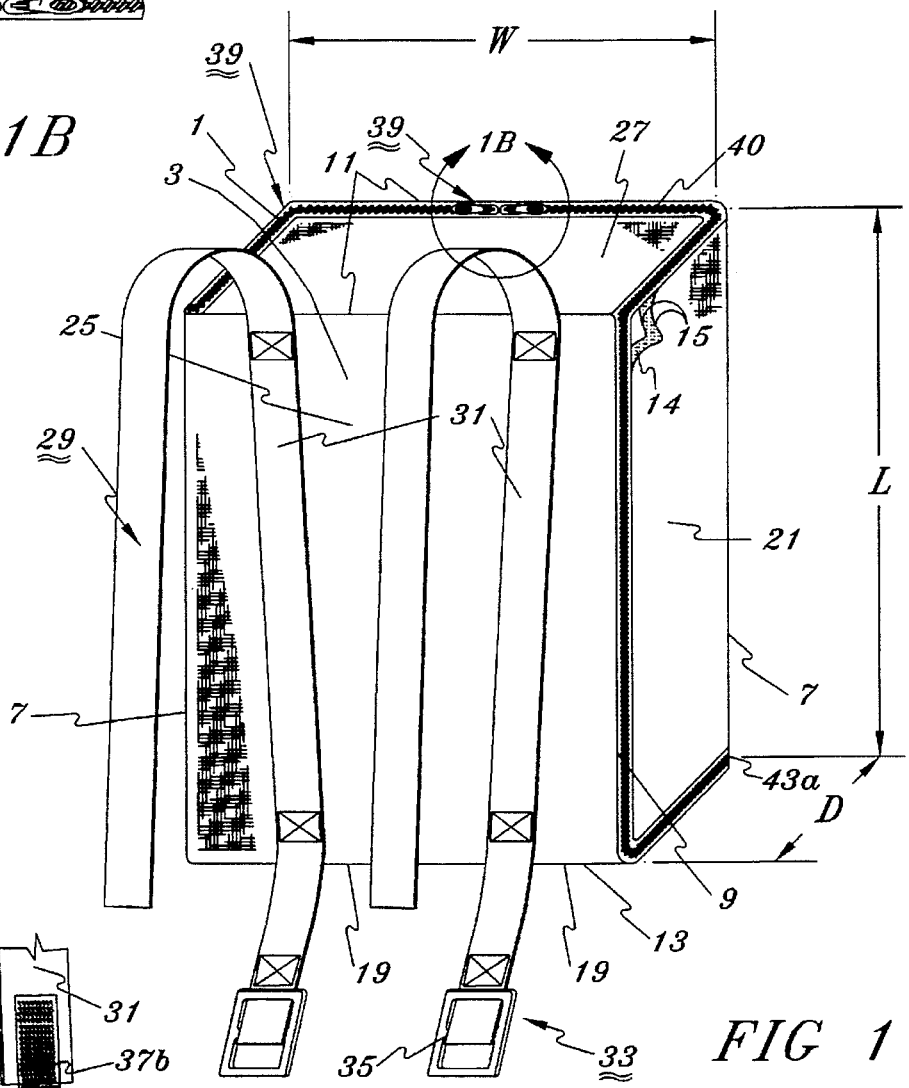
FIG. 1 is a perspective view of the invention in the form of a backpack with portions broken away showing various aspects of the construction.
Figure 2:
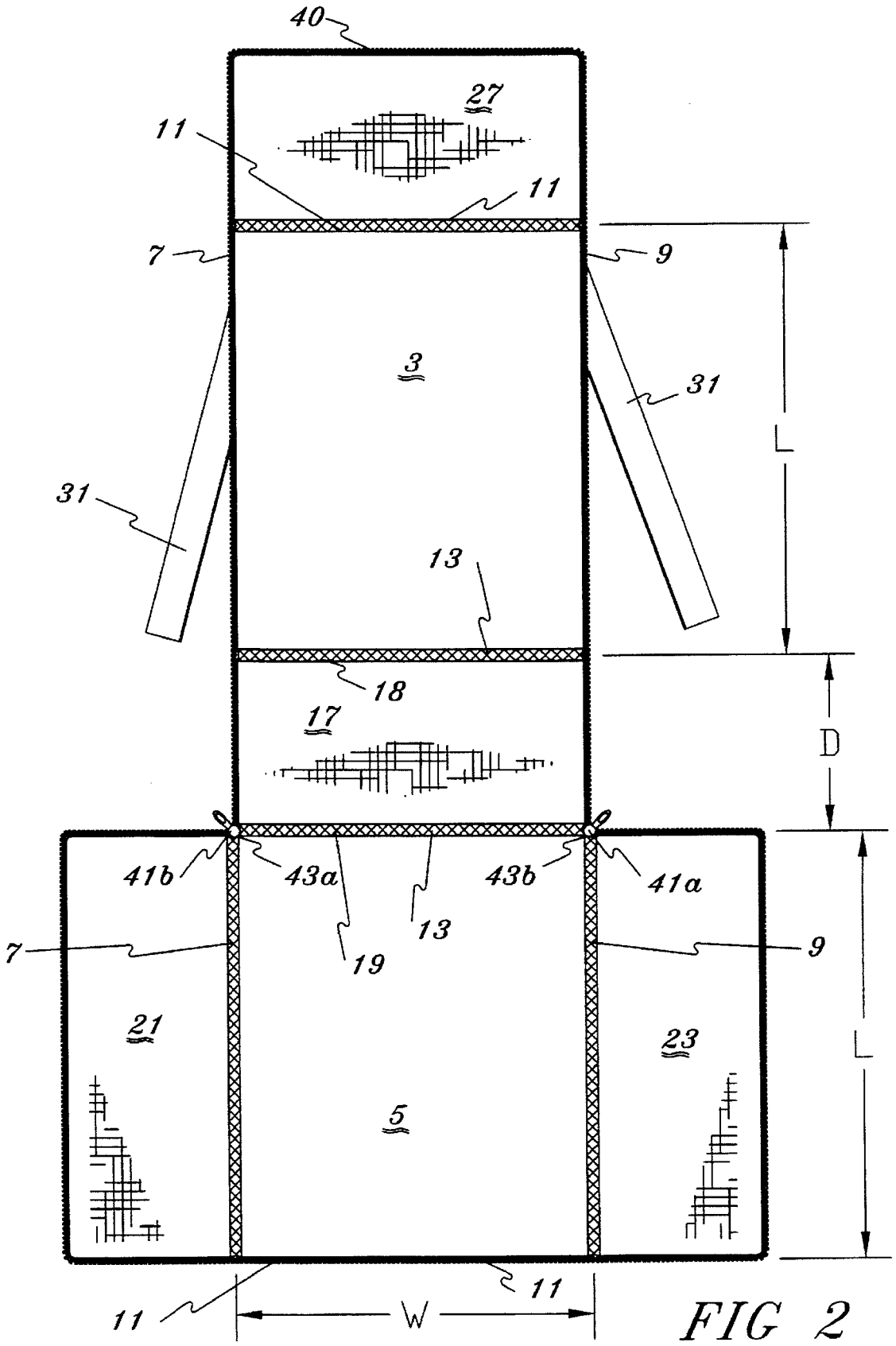
FIG. 2 is a planar view of all of the panels joined together in one monolithic configuration.
Figure 3:
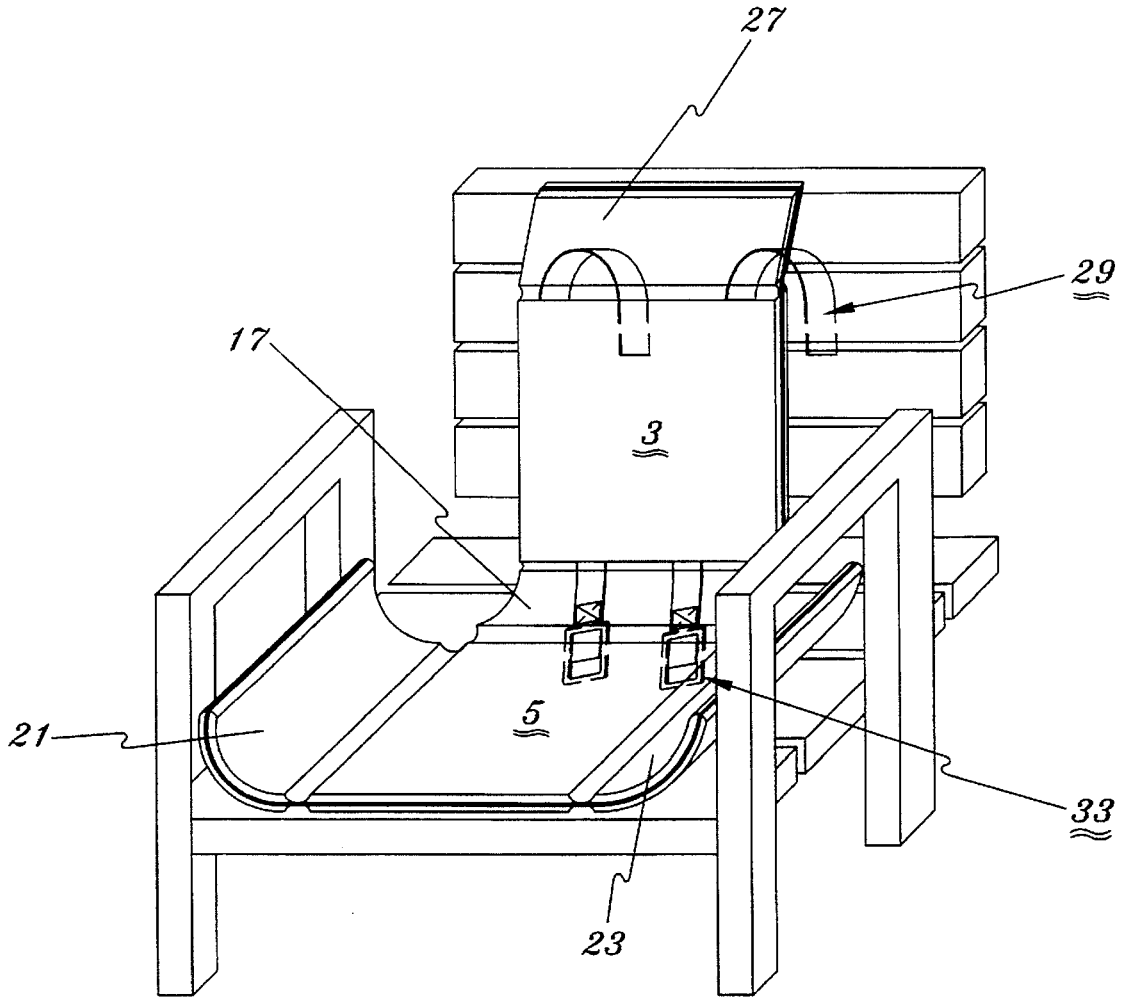
FIG. 3 is an illustrative view of the invention applied to a generic seat.

Turning now to the drawings, wherein like elements are identified with like numerals throughout the figures, an embodiment of the invention is shown in FIG. 1, in its enclosed configuration as a backpack and in FIGS. 2 and 3 in its open configuration as a stadium seat or chair cover. This embodiment is shown to comprise first and second broad or large panels 3 and 5, respectively, preferably of equal lengths L and widths W, as shown in FIG. 1, positioned in generally upright, aligned and spaced-apart arrangement to form the front and rear portions, respectively, of the backpack. Panels 3 and 5 are defined by spaced-apart side edges 7 and 9 and spaced-apart top and bottom edges 11 and 13, respectively.

Panels 3 and 5, as well as the other panels introduced herein, may be constructed from a wide variety of materials. Padding in the form of a sheet or sheets of foam 14 or other such material, covered by inner and outer sheets of material 15 such as rip-stop nylon cloth and the like, are preferred. The peripheral edges of the panels may be reinforced with a ribbon 16, or strip of nylon material or the like. It is desirable that the outside material 15 be waterproof, strong enough to withstand the rigors of out-of-door usage, and yet be pliable enough to be comfortable when sat upon or when used as a chair cover.

A shorter, third panel 17, preferably of the same width W as panels 3 and 5, is hingedly attached along its opposed rear and forward edges 18 and 19, respectively, to panel edges 13 of the first and second panels 3 and 5 as shown in FIGS. 2 and 3. The hinged attachment may be made by sewing the panels together along their respective seams. However, it is preferred that all hingedly connected panels now identified and to be hereinafter introduced, be formed of a single cut-out panel, as shown in FIG. 2, and rows of stitching (x's) run along the attaching hinges as already known in the art of sheet material construction. With first and second panels 3 and 5 arranged in upright, spaced-apart position, as shown in FIG. 1, the third panel 17 now forms the bottom panel of the backpack and spaces panels 3 and 5 apart a depth D.

Opposed fourth and fifth side panels, 21 and 23, respectively, are provided and hingedly attached to said second panel 5 along each of its side edges 7 and 9 to form respectively the sides of the backpack. It is preferred that panels 21 and 23 are co-extensive with the length L of panels 3 and 5 and of a width W so that, when joined along their respective edges to first, second and third panels 3, 5 and 17, there is created a cavity 25 within the backpack such that nothing contained therein can fall out from the sides or bottom thereof.

A sixth or top panel 27 is hingedly attached to said first panel 3 for pivotal movement over onto the top of the backpack to seal off cavity 25. Again, it is preferred that panel 27 be of the same size and shape of third panel 17 and arranged fully co-extensive with the width W of first and second panels 3 and 5 and also be of the same depth D to form the enclosed backpack into a hollow parallel-piped structure having cavity 25 enclosed therein.

Figure 1A:
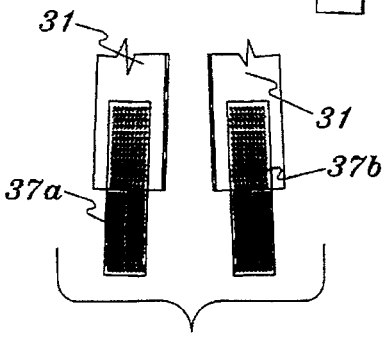
FIG. 1*a* is a close-up view of a portion of a strap length adjustment means in FIG. 1

A strap 29 is provided, preferably attached to the outside surface of first panel 3, for looping over the shoulders of the user to hold the embodiment of the invention 1 against the back as a backpack. As shown in FIG. 1, strap 29 may be merely a pair of straps 31 attached in spaced-apart arrangement on the front of panel 3, converging as they descend, to provide stability when looped over the shoulders, and containing a length-adjuster 33, such as a length-adjustment buckle 35 or, as shown in FIG. 1*a*, loop strips 37*a* and hook strips 37*b* that may be used to adjust the length of the straps. Other forms of straps 29 are possible and are fully contemplated in this invention.

Loop elements 37*a* and hook elements 37*b* are resilient and deformable and, when pressed together become removably entangled, securing them mutually together. Strips 37*a* and 37*b* can be released from entangled engagement by positively pulling hook elements 37*b* away from loop elements 37*a* and 37*b* or vice versa. Loop and hook fabric elements 37*a* and 37*b* are available under the trademark "VELCRO," more specific details of which may be had from U.S. Pat. No. 2,717,437 entitled, VELVET TYPE FABRIC AND METHOD OF PRODUCING SAME issued Sep. 13, 1955, to George de Mestral and U.S. Pat. No. 3,114,951 entitled, DEVICE FOR JOINING TWO FLEXIBLE ELEMENTS issued Dec. 24, 1963, to George de Mestral. The material is hereinafter referred to as "Velcro®" loop material and "Velcro®" hook material, a product of American Velcro, Inc.

Figure 6:
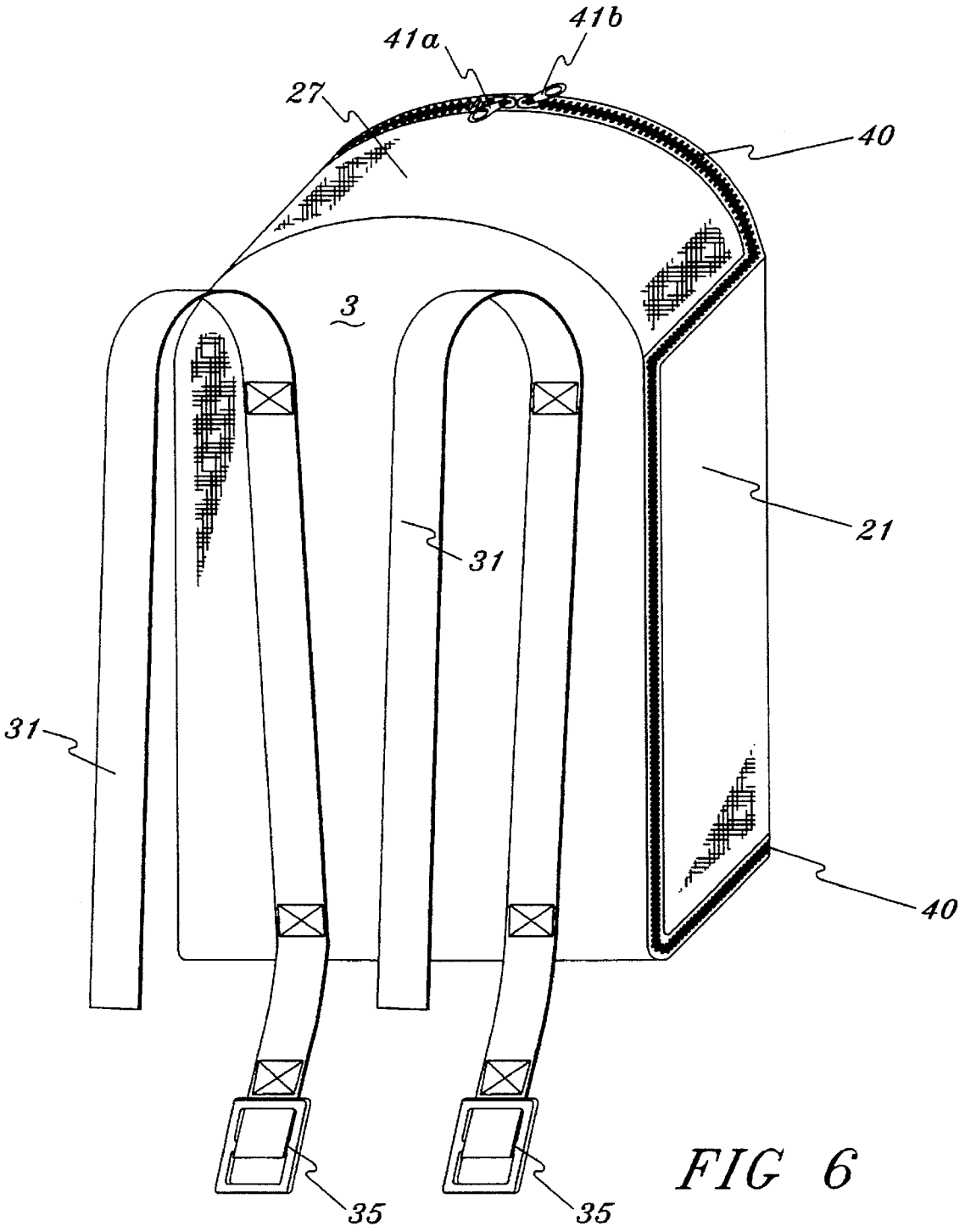
FIG. 6 is an alternate embodiment of the invention as depicted in FIG. 1.

An inter-engaging fastener 39 is provided and attached to all non-hingedly connected edges of panels 3, 5, 17, 21, 23 and 27, such that the combination backpack and chair cover is shiftable between a first position, wherein all the panels are interconnected along their marginal edges to form the fully enclosed backpack shown in FIGS. 1 and 6, and a second position wherein the panels are open, as shown in FIGS. 2 and 3, to allow first, second and third panels 3, 5 and 17 to form an elongated cover for the back and seat portions of a common stadium seat or chair, and wherein said panels 21 and 23 provide further lateral coverage to the seat portion and the arms of the chair.

Figure 4A:
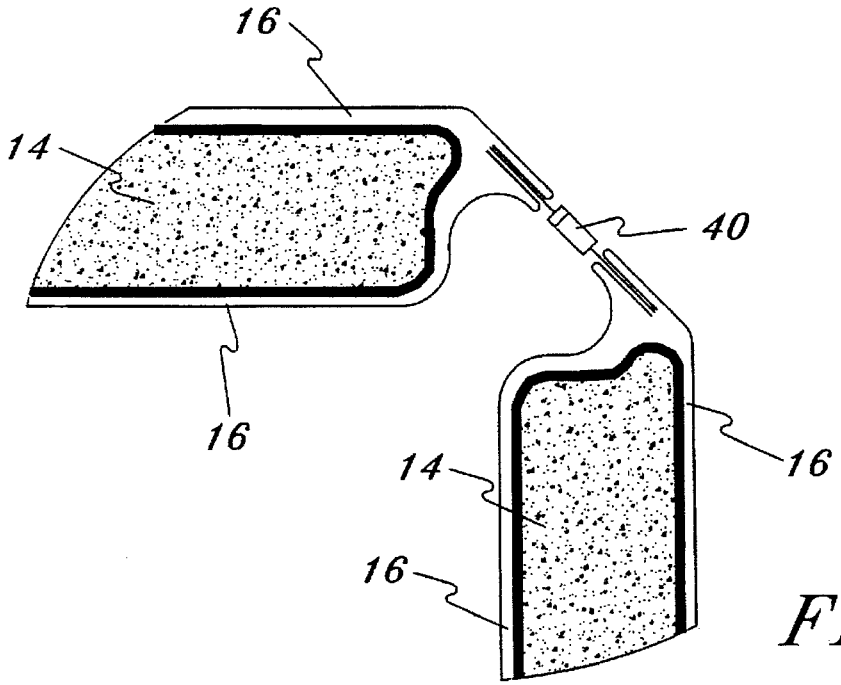
FIG. 4*a* is a close-up view of a portion of FIG. 4.
Figure 4:
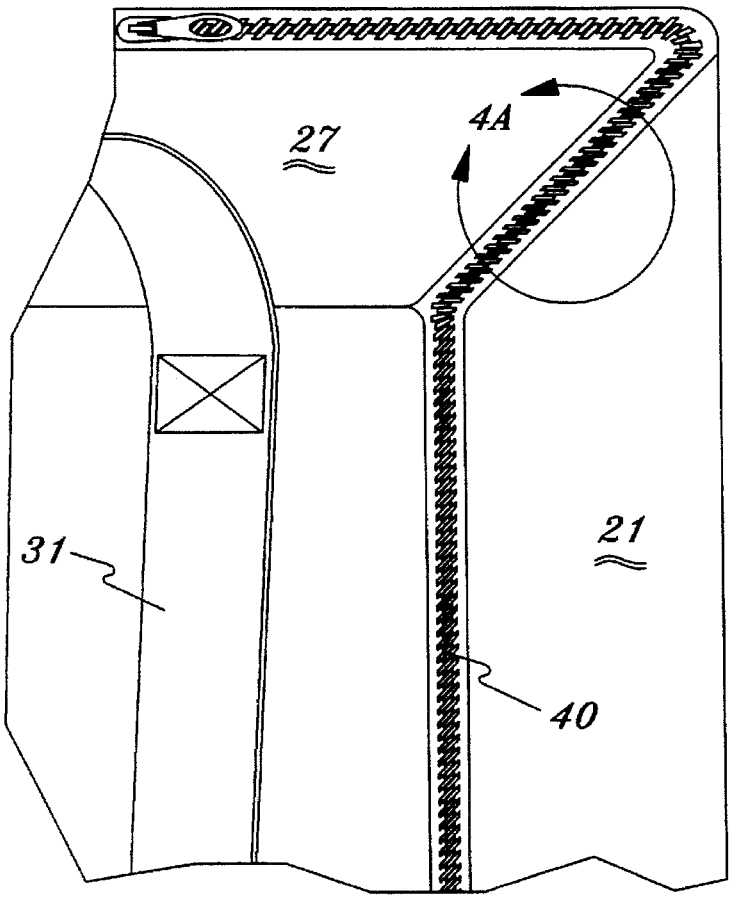
FIG. 4 is an illustrative view of a portion of the invention showing the preferred means of interconnecting and fastening the various panels together.

It is preferred that the fastener 39 be in the form of a continuous zipper 40 attached along the marginal edges of the aforesaid panels with a pair of zipper slides 41*a* and 41*b* installed so as to be operable in opposite directions from each other as shown in FIGS. 1, 1*b* and 6. As shown in FIG. 1, zipper slides would be slidable starting at the midpoint of the intersection of top panel 27 with second panel 5 and progressing outward along the top panel rear edge, forward along the intersection of top panel 27 with side panels 21 and 23 (see FIG. 4), downward along the intersection of side panels 21 and 23 with first panel 3, and rearward along the intersection of side panels 21 and 23 with bottom panel 17, to terminate at comers 43*a* and 43*b* that are formed by the intersection of rear panel 5, bottom panel 17 and respective side panels 21 and 23.

Figure 5A:
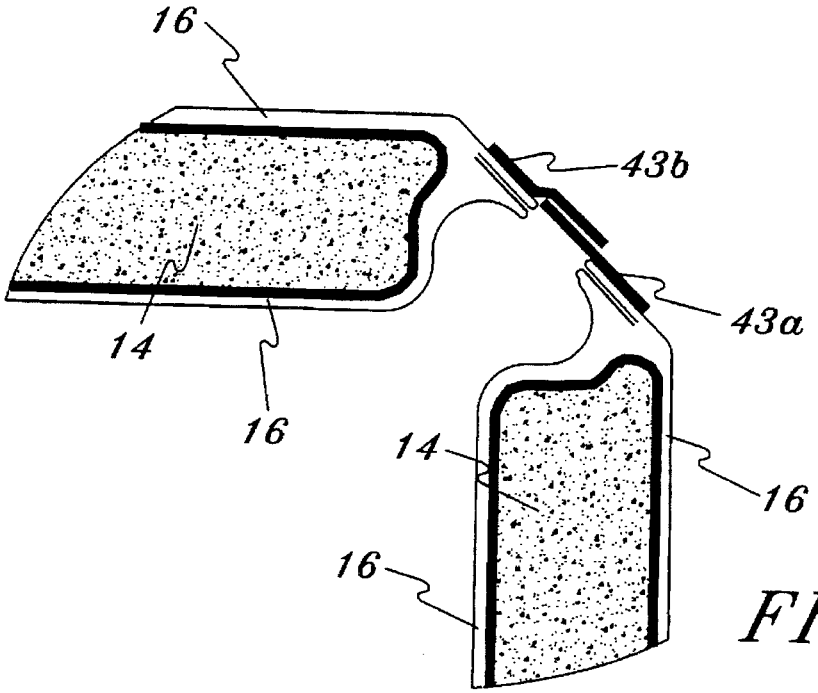
FIG. 5*a* is a close-up view of the Velcro® fasteners for use herein.
Figure 5:
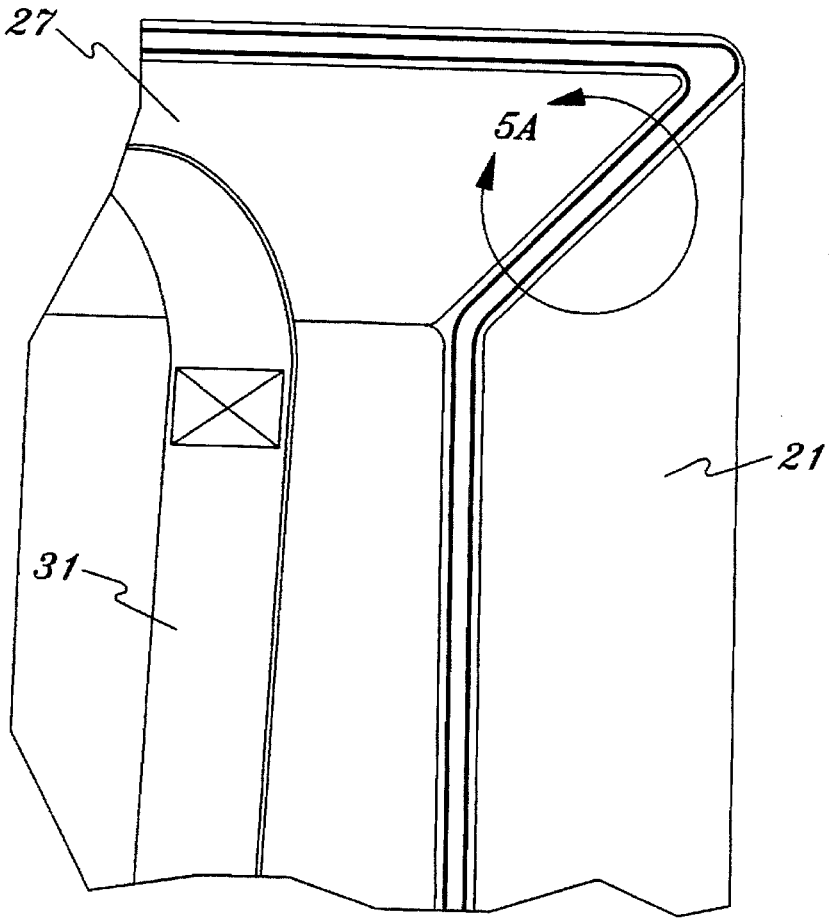
FIG. 5 an illustrative view showing another embodiment of the panel interconnecting means.

The fastener 39 may also be provided in the form of Velcro® loop and hook strips 45*a* and 45*b*, as shown in FIG. 5 and 5*a*, wherein one strip 43*a* is sewn along the edges of the panels just described, and the other strip 43*b* is sewn to the other edges of the interconnecting panels such that a portion of strip 43*b* overlaps strip 43*a* for removable interengagement therewith.

In its fully-opened configuration and placement as shown in FIG. 2 and 3, the first panel 3 provides a cover or cushion for the user's lower back or lower lumbar against the seat-back portion of the chair or stadium seat, the second and third panels 5 and 17 provide a cover or cushion for the user against the seat portion of the chair or stadium seat, and the sixth or top panel 27 provides cover or cushion for the user's upper back or upper lumbar against the upper portion of the seat-back portion of the chair or stadium seat, or the top panel 27 can be folded rearward to provide a head or neck cushion to the user against the top of the seat-back depending on the height of the seat-back.

Side panels 21 and 23 are now conveniently placed to provide thigh protection outboard on the stadium seat to cushion the user against or cover the hot or cold surface of the seat portion and arms of the chair or stadium seat. This is all the more important for users that may be more heavily bodied in the thighs and require this extra protection.

Straps 31 are now conveniently tucked behind first panel 3 and length-adjuster 33 is tucked behind third panel 17 to remain out of the way and out of contact with the user.

Alternate embodiments of the invention are shown in FIGS. 6, 7, 8, 9, and 10. FIG. 6 shows the contour of top panel 27 modified to provide a rounded-top backpack. This alternate embodiment shows how the combination backpack and chair cover may be modified to keep abreast with styling changes and yet retain the functionality of the invention.

Figure 7:
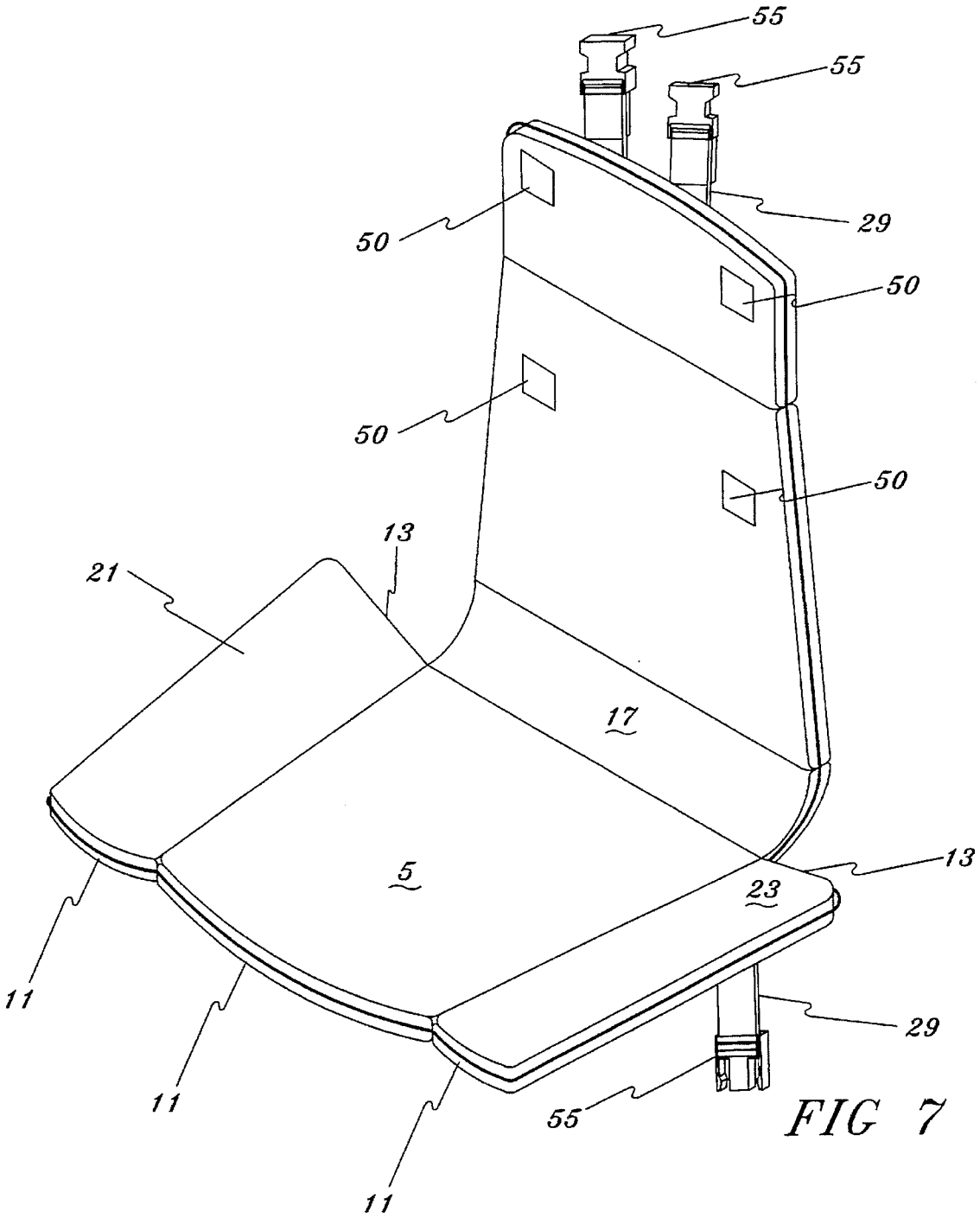
FIG. 7 is an alternate embodiment of the invention as depicted in FIG. 2 and 3.
Figure 8:
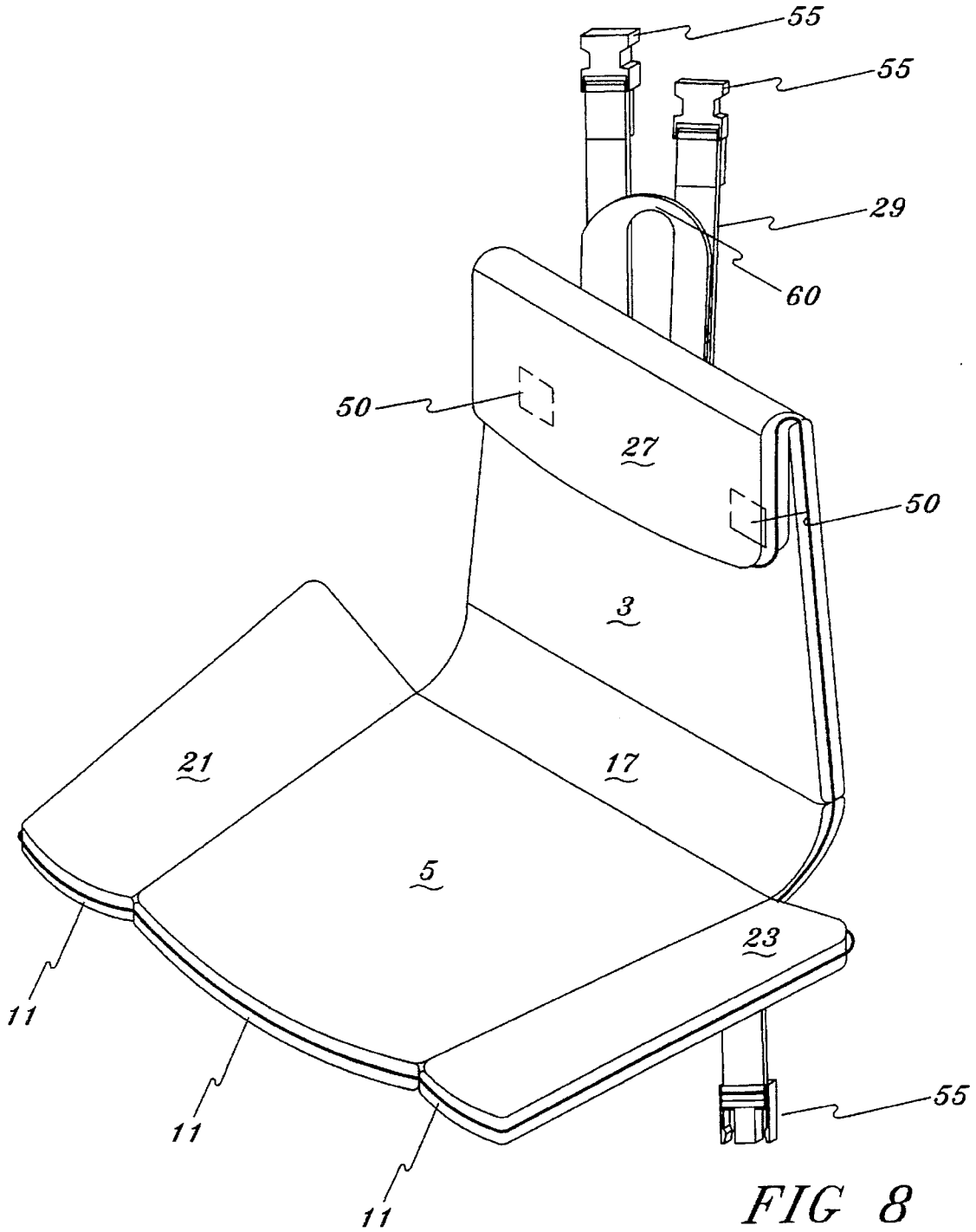
FIG. 8 is an alternate embodiment of the invention as depicted in FIG. 2 and 3.
Figure 9:
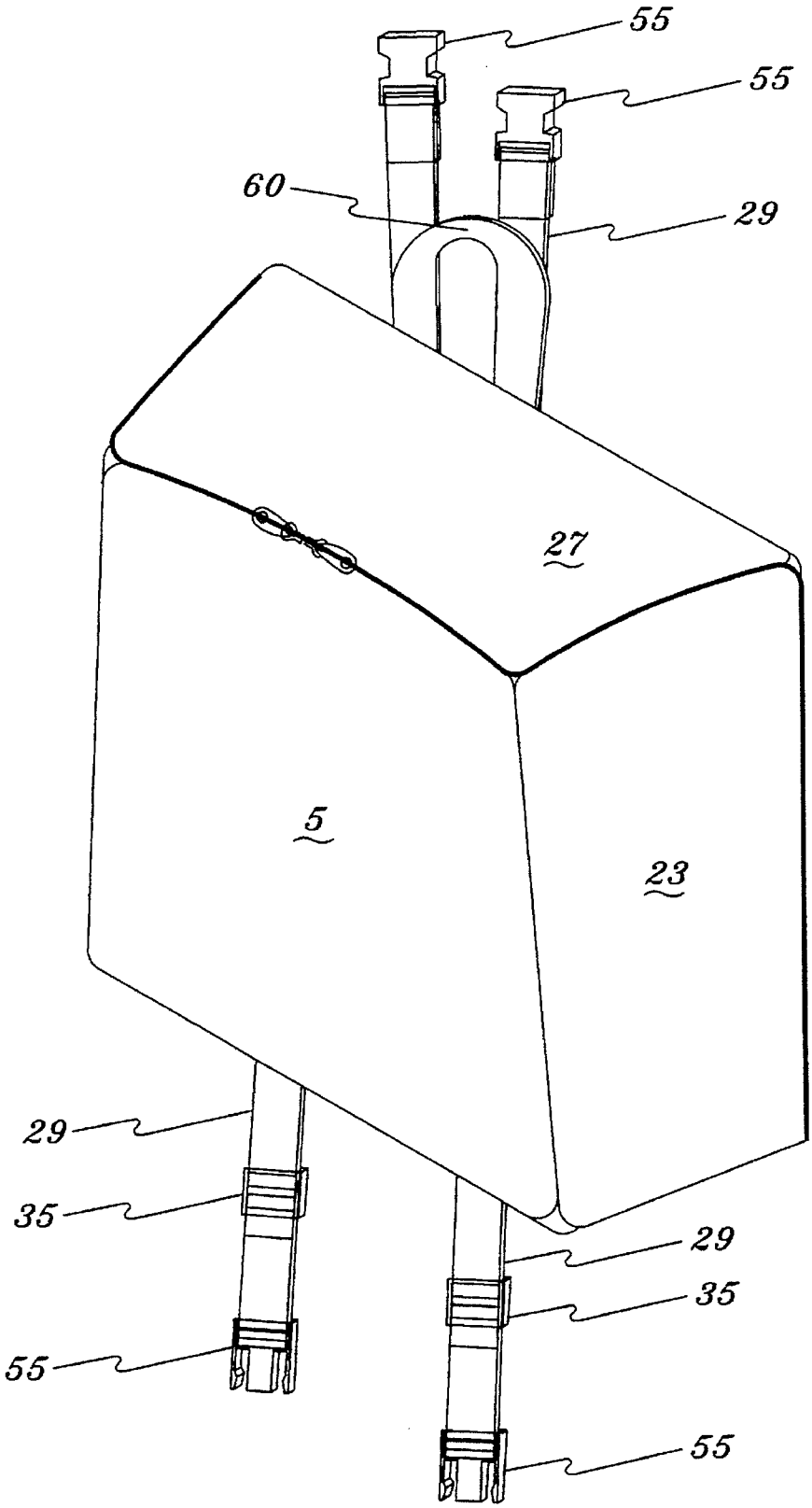
FIG. 9 is an alternate embodiment of the invention as depicted in FIG. 1.
Figure 10:
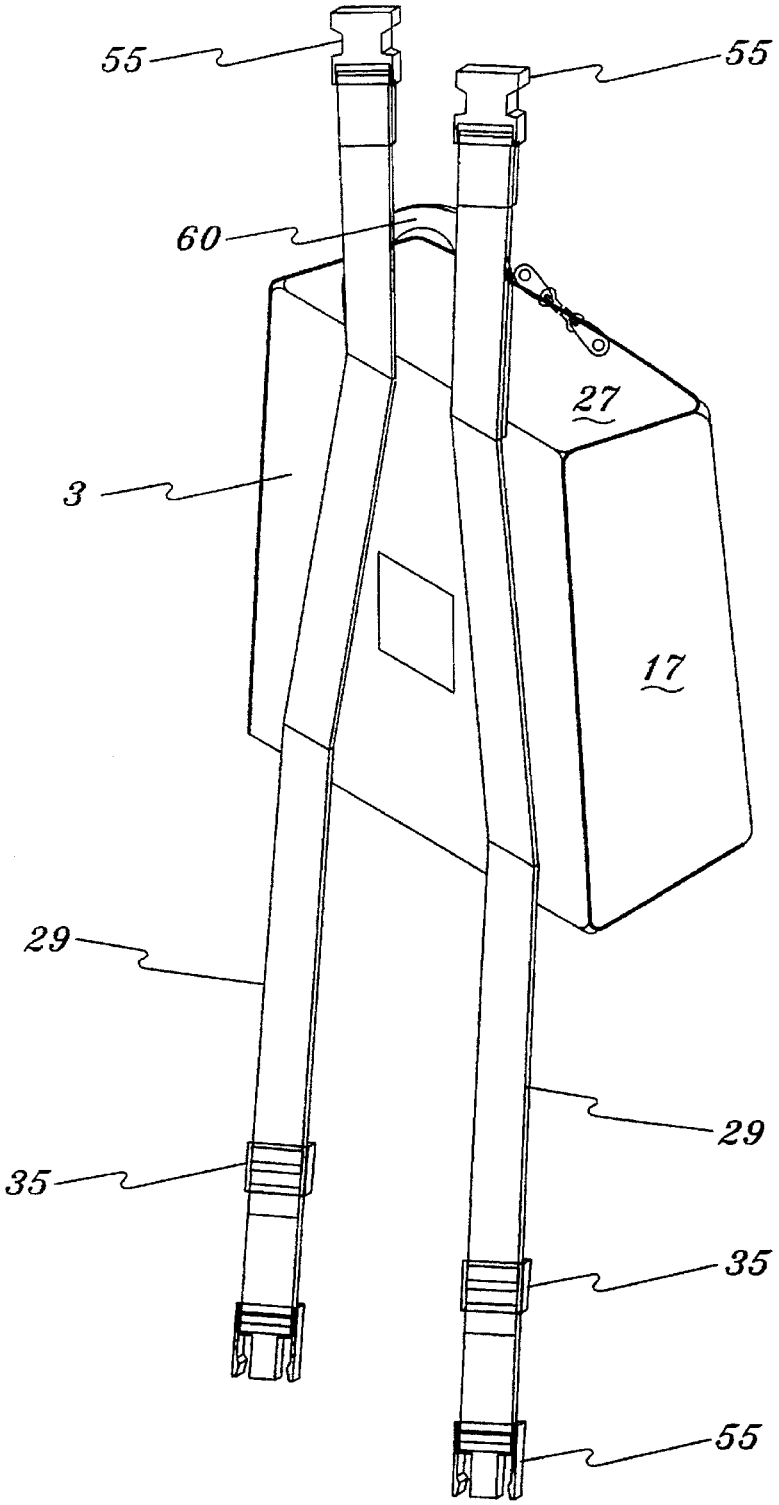
FIG. 10 is an alternate embodiment of the invention as depicted in FIG. 1.

FIGS. 7 and 8 show fasteners 50 attached to the inner surfaces of the first and sixth panels 3 and 27 to allow the sixth or top panel 27 to be folded down and held in place against the first panel 3 to provide additional lower back or lower lumbar support. In addition, FIGS. 7, 8, 9, and 10 show that the combination backpack and chair cover can be modified further to provide a more ergometric design. The first, second, fourth, and fifth panels 3, 5, 21, and 23 are tapered to provide a better fit to the user's back. The edge 11 of the second, fourth, and fifth panels 5, 21, and 23 are curved to provide a more appealing shape.

Additionally, FIGS. 7, 8, 9, and 10 show a handle 60 connected to the strap 29 that allows the combination backpack and chair cover to be carried without using the shoulder straps 31. The handle 60 can also be connected to any of the panels 3, 5, 17, 21, 23, or 27. Also, the straps 31 are shown to include quick-release buckles 55 for quick mounting on and removal from the user of the combination backpack and chair cover.

Thus, the combination backpack and chair cover of the present invention provides many benefits over the prior art. While the above description contains many specificities, these should not be construed as limitations on the scope of the invention, but rather as an exemplification of the preferred embodiments thereof. Many other variations are possible.

Accordingly, the scope of the present invention should be determined not by the embodiments illustrated above, but by the appended claims and their legal equivalents.

What is claimed:

1. A stadium seat cushion comprising a seat-back cushion, a first seat cushion, a second seat cushion interposed between and hingedly connected to said seat-back cushion and said first seat cushion, a head cushion hingedly connected to said seat-back cushion at a hinge connector, first and second lateral seat cushions hingedly connected to said first seat cushion, said first seat cushion interposing said first and second lateral seat cushions, a first fastener member attached to said head cushion, and a second fastener member attached to said seat back cushion, said first and second fastener members being located equidistantly from the hinge connection between said seat back and head cushions enabling said head cushion to be releasably held in place against the seat-back cushion and providing additional lower lumbar cushion and support to the user.

2. The stadium seat cushion of claim 1, further comprising an outer edge extending along said seat-back, first seat, second seat, head, and first and second lateral cushions, and an inter-engaging fastener being fixedly attached to said outer edge enabling interconnection between said head cushion and said first seat cushion; said head cushion and said first and second lateral seat cushions; said second seat cushion and said first and second lateral seat cushions; and said seat-back cushion and said first and second lateral seat cushions, said inter-engaging fastener enabling conversion of the stadium seat cushion from a seat cushion to a backpack, with said first seat cushion and said seat-back cushion forming opposing rear and front panels of the backpack, respectively, said head cushion and said second seat cushion forming opposing top and bottom panels of the backpack, respectively, and said first and second lateral seat cushions forming the opposing side panels of the backpack, and forming a cavity therein.

3. The stadium seat cushion of claim 2, further comprising a plurality of straps attached to said seat-back cushion enabling it to be carried when converted to a backpack.

4. The stadium seat cushion of claim 2, wherein said inter-engaging fastener comprises a zipper or loop and hook fasteners.

5. The stadium seat cushion of claim 3, further comprising a handle fixedly attached to one of said straps, said head cushion, said seat-back cushion, said first seat cushion, said second seat cushion, said first lateral seat cushion, or said second lateral seat cushion.

6. A chair cover comprising a first panel adapted to cover and cushion the main seat-back portion of a chair, a second panel adapted to cover and cushion the main seat portion of a chair, a third panel interposed between and hingedly attached to said first and second panels, said third panel being adapted to cover and cushion the rear seat portion of a chair, a fourth panel adapted to laterally cover and cushion a first arm and lateral seat portion of a chair, said fourth panel being hingedly attached to said second panel, a fifth panel adapted to laterally cover and cushion a second arm and lateral seat portion of a chair, said fifth panel being hingedly attached to said second panel, said second panel being interposed between said fourth and fifth panels, a sixth panel adapted to cover and cushion the top or upper portion of a seat-back portion of a chair, said sixth panel being hingedly attached to said first panel forming a hinged connection, and first and second fastener members attached to said first and sixth panels, respectively, said first and second fastener members being located equidistantly from the hinged connection between said first and sixth panels enabling said sixth panel to be releasably held in place against said first panel and providing additional lower lumbar cushion and support for the user.

* * * * *

UNITED STATES PATENT AND TRADEMARK OFFICE

CERTIFICATE OF CORRECTION

PATENT NO. : 5,641,199

DATED : June 24, 1997

INVENTOR(S) : Winnie BOND-MADSEN

It is certified that error appears in the above-indentified patent and that said Letters Patent is hereby corrected as shown below:

Column 1, line 32, change "modem" to --modern--.

Column 2, line 59, change "much" to --touch--.

Column 6, line 8, change "comers" to --corners--.

Signed and Sealed this

Twentieth Day of January, 1998

*Attest:*

*Attesting Officer*

BRUCE LEHMAN

*Commissioner of Patents and Trademarks*